US007696740B2

(12) United States Patent
Zhou et al.

(10) Patent No.: US 7,696,740 B2
(45) Date of Patent: Apr. 13, 2010

(54) EMI SUPPRESSING REGULATOR

(75) Inventors: Junfeng Zhou, Heverlee (BE); Wim Dehaene, Kessel-Lo (BE)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 301 days.

(21) Appl. No.: 11/972,585

(22) Filed: Jan. 10, 2008

(65) Prior Publication Data

US 2008/0174284 A1 Jul. 24, 2008

(30) Foreign Application Priority Data

Jan. 10, 2007 (GB) ..... 0700407.0

(51) Int. Cl.
*G05F 1/40* (2006.01)

(52) U.S. Cl. ..... 323/288

(58) Field of Classification Search ..... 323/266, 323/268, 271, 282, 285–288, 349–351
See application file for complete search history.

(56) References Cited

U.S. PATENT DOCUMENTS 6,710,583 B2 * 3/2004 Stanescu et al. ..... 323/280
7,196,502 B2 * 3/2007 Sugiura et al. ..... 323/274
2004/0169550 A1 9/2004 Perrier et al.
2009/0289608 A9 * 11/2009 Al-Shyoukh ..... 323/238

FOREIGN PATENT DOCUMENTS

DE 10249162 A1 5/2004
EP 1061428 A1 12/2000
GB 2062373 A 5/1981
GB 2356991 A 6/2001

* cited by examiner

*Primary Examiner*—Matthew V Nguyen
(74) *Attorney, Agent, or Firm*—Robert F. Hightower

(57) ABSTRACT

A regulator circuit receives a power supply and provides a regulated power supply output suitable for integrated circuitry. It has a controllable current source circuit, a controller and a capacitor, such that an output of the controllable current source circuit can provide a lower frequency current part of the regulated power supply output, and the capacitor can supply a higher frequency current part of the regulated power supply output. The controllable current source circuit is controlled according to feedback from the regulated power supply output, and to restrict a rate of change of the output of the controllable current source circuit. The amount of EMI noise caused by high rate of change of current in power supply lines to the regulator circuit can be reduced. This can be done more efficiently or using a smaller capacitor than known arrangements.

22 Claims, 4 Drawing Sheets

EMI SUPPRESSING REGULATOR

CROSS-REFERENCE TO RELATED APPLICATIONS

This patent application claims the benefit of British Patent Application Serial No. 0700407.0, filed Jan. 10, 2007, which patent application is incorporated herein by reference in its entirety.

FIELD OF THE INVENTION

This invention relates to regulator circuits, to integrated circuits having such regulator circuits, to methods of manufacturing the same, and methods of regulating power supplies.

BACKGROUND

In many technical fields EMI (electromagnetic interference) is a constraint. For example in automotive vehicles, the electromagnetic environment generated by devices like ABS braking systems, airbag sensors, or engine management, is omnipresent. Hence, EMC (electromagnetic compatibility) is of great importance to safety. Without a proper design, EMC of integrated circuits will become a limiting factor in the performance of every advanced electronic system. However, due to more sizable wires forming antennas and to more rapidly changing currents, the current variation (di/dt) in power supply lines generates most of the noise radiation emitted. Therefore, making di/dt values smaller is necessary in order to reduce the EMC problem at the chip-level.

It is known to use a capacitor coupled between the supply lines on board the chip, or if too large to be integrated, then located next to the chip. It is also known from U.S. Pat. No. 6,489,815 that in buffer circuits having first and second current sources connected to different supply lines, to produce a switched output, depending on use of a termination resistor, a large constant current varies upon switching, which increases radiation noise. To suppress such noise by suppressing a variation of the current, a low-noise buffer circuit according to this document has a resistor connected between the first and second current sources.

U.S. Patent Application Publication No. 2004/0257053 has a power supply circuit which comprises a differential amplifier for feeding out a voltage as a control voltage in accordance with a difference between a feedback voltage commensurate with an output voltage and a reference voltage, and an output current control element for feeding out an output current in accordance with the control voltage fed thereto from the differential amplifier. A voltage on the output line is fed back as the feedback voltage to the differential amplifier, the feedback line is connected to an output line, and a constant current source, connected between the feedback line and ground, is provided for generating a sink current by which the control voltage fed to the output current control element is raised to a predetermined value.

For a configuration in which a capacitor is connected between the output line and ground, at least the electrical charge stored in the capacitor is removed when the switching element is turned on. Therefore, when the load changes from a heavy load to no load or to a light load and when the output voltage is raised due to a transient phenomenon, the electrical charge stored in the capacitor is removed swiftly. This makes it possible to further suppress the fluctuations of the output voltage caused by load fluctuations, and improve properties in the transient response.

When the load changes from no load to a heavy load, the gate voltage of the output current control element, is raised by the sink current Ic that is pulled in by the constant current source during the no-load period preceding the change in load condition. This makes it possible for the current control element to respond faster, thereby reduce fluctuations of the output voltage caused by fluctuating load conditions to a minimum, and, in addition, improve properties in the transient response. However, this will tend to worsen the rate of change of current drawn by the current control element.

SUMMARY OF THE INVENTION

An object of the invention is to provide improved regulator circuits, integrated circuits having such regulator circuits, methods of manufacturing the same, and/or methods of regulating power supplies. According to a first aspect, the invention provides:

a regulator circuit arranged to receive a power input, e.g. from a power supply and to provide a regulated power supply output suitable for driving semiconductor or electronic devices or integrated circuitry, etc., the regulator circuit having a controllable current source circuit, a controller arranged to control the controllable current source circuit, and a capacitor, the controllable current source circuit and the capacitor being coupled together such that an output of the controllable current source circuit can provide a lower frequency current part of the regulated power supply output (or in other words a slowly varying quiescent current), and such that the capacitor can supply a higher frequency current part of the regulated power supply output (or in other words transient, rapidly varying peak current), and the controller being arranged to control the controllable current source circuit according to feedback from the regulated power supply output, and to restrict a rate of change of the output of the controllable current source circuit.

The present invention also provides a regulator circuit arranged to receive a power supply (Vbat) and to provide a regulated DC power supply output (Vout, VDD_core) to a varying load, the varying load causing current drain with lower frequency and higher frequency components from the power supply, the regulator circuit having a controllable current source circuit (M1, M2), a controller (OTA, Caux, Raux) arranged to control the controllable current source circuit, and a capacitor (Ctank), the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source circuit.

By providing a current source with feedback and limited rate of change, the amount of EMI noise caused by high rate of change of current in power supply lines to the regulator circuit can be reduced this can be done more efficiently or using a smaller capacitor than known arrangements or with lower average power dissipation. This in turn leads to reduced manufacturing costs for a given level of EMC. Any other features can be added, and some examples of such additional features will be described below.

An additional feature of some embodiments is the capacitance comprising an integrated capacitance component. This can keep component count and manufacturing costs lower, but usually restricts the size of the capacitance.

Another such feature is the regulator circuit being integrated with the integrated circuitry coupled to the regulated power supply output. Various degrees of integration can be envisaged, encompassing for example being on the same die, or in same hybrid, or in the same package as the integrated circuitry.

Another such feature is the regulator circuit being arranged to provide attenuation in rate of change of current of the received power supply for a given rate of change of current of the regulated power supply output by more than −20 dB at frequencies above $10^8$ Hz.

An additional feature of some embodiments is the controllable current source circuit being arranged to charge the capacitor, though other charging circuits can be envisaged.

Another such feature is the controller comprising a low pass filter circuit in a feedback path from the regulated power supply output.

Another such feature is the filter comprising an operational amplifier.

Another such additional feature is the controllable current source comprising a cascode structure, though other circuits can be envisaged.

Another such additional feature is the cascode structure comprising a pair of series coupled transistors, a first of the series coupled transistors being controlled by the controller, and a second being controlled by a voltage follower circuit.

Another such additional feature is a series voltage regulator arranged to convert the voltage of the regulated power supply output.

Another such feature is an integrated circuit having power control and logic circuitry, and the regulator circuit arranged to provide the regulated power supply to the logic circuitry.

Another aspect of the invention is a corresponding method of regulating power, e.g. a method of regulating a power supply (Vbat) to provide a regulated power supply output (Vout, VDD_core) (e.g. to a varying load, the varying load causing current drain with lower frequency and higher frequency components from the power supply), a regulator circuit being provided having a controllable current source circuit (M1, M2), and a capacitor (Ctank), the method having the steps of receiving the power supply and controlling the controllable current source circuit according to feedback from the regulated power supply output to provide a lower frequency current part of the regulated power supply output, such that the capacitor can supply a higher frequency current part of the regulated power supply output, and controlling the controllable current source circuit to restrict a rate of change of the output of the controllable current source circuit.

Another aspect of the invention is a method of manufacturing a regulator circuit, e.g. a method of manufacturing the integrated circuit having power control and logic circuitry, and a regulator circuit, the regulator circuit being arranged to receive a power supply and to provide a regulated power supply output (e.g. to a varying load, the varying load causing current drain with lower frequency and higher frequency components from the power supply), the regulator circuit having a controllable current source circuit (M1, M2), a controller (OTA, Caux, Raux) arranged to control the controllable current source circuit, and a capacitor (Ctank), the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source circuit, the method having the steps of forming the controllable current source circuit, forming the controller arranged to control the controllable current source circuit, and forming the capacitor.

Any of the additional features can be combined together and combined with any of the aspects. Other advantages will be apparent to those skilled in the art, especially over other prior art. Numerous variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which.

DESCRIPTION OF THE PREFERRED EMBODIMENTS

Figure 1:
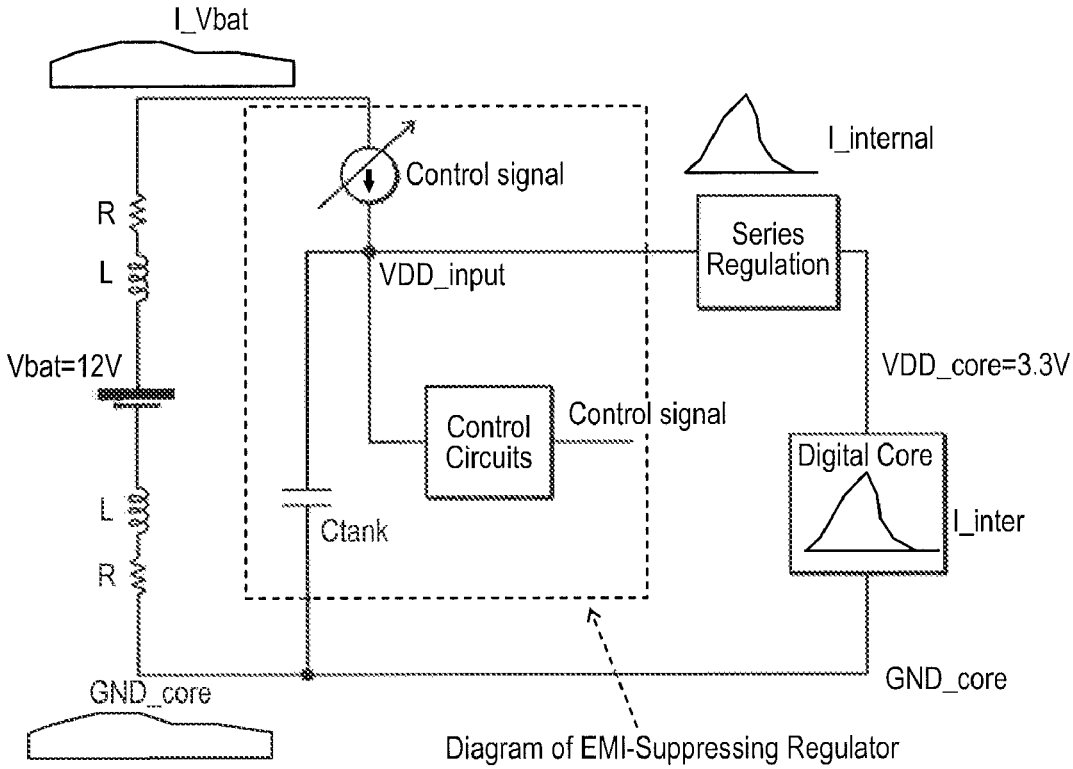
FIG. 1 shows a block diagram of an embodiment, showing an EMI-Suppressing Regulator circuit and neighbouring circuitry.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

The term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein. Numerical values or ranges are approximate.

Embodiments of present invention relate to a power regulator circuit or device. The power regulator circuit provides a regulated power supply output and has a controller arranged to control a controllable current source circuit according to feedback from the regulated power supply output, and to limit a rate of change of the output of the controllable current source circuit.

In particular the present invention provides a regulator circuit arranged to receive a power input, e.g. from a power supply and to provide a regulated power supply output suitable for driving semiconductor or electronic devices or integrated circuitry, etc. The output is generally to a varying load, the varying load causing current drain with lower frequency and higher frequency components from the power supply. The regulator circuit has a controllable current source circuit, a controller arranged to control the controllable current source circuit, and a capacitor, the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source circuit. An additional feature of some embodiments is the capacitance comprising an integrated capacitance component. This can keep component count and manufacturing costs lower, but usually restricts the size of the capacitance. Another such feature is the regulator circuit being integrated with the integrated circuitry coupled to the regulated power supply output. Various degrees of integration can be envisaged, encompassing for example being on the same die, or in same hybrid, or in the same package as the integrated circuitry. Another such feature is the regulator circuit being arranged to provide attenuation in rate of change of current of the received power supply for a given rate of change of current of the regulated power supply output by more than −20 dB at frequencies above $10^8$ Hz. An additional feature of some embodiments is the controllable current source circuit being arranged to charge the capacitor, though other charging circuits can be envisaged. Another such feature is the controller comprising a low pass filter (integrated) circuit in a feedback path from the regulated power supply output. Another such feature is the filter comprising an operational amplifier. Another such additional feature is the controllable current source comprising a cascode structure, though other circuits can be envisaged. Another such additional feature is the cascade structure comprising a pair of series coupled transistors, a first of the series coupled transistors being controlled by the controller, and a second being controlled by a voltage follower circuit. Another such additional feature is a series voltage regulator arranged to convert the voltage of the regulated power supply output. Another such feature is an integrated circuit having power control and logic circuitry, and the regulator circuit arranged to provide the regulated power supply to the logic circuitry.

Some embodiments can suppress for example to a maximum limit of 35 dB di/dt noise at high frequency (e.g. the filtering will be similar to that of a first order low pass filter with a cut-off frequency around 1 MHz, an attenuation of 20 dB beyond the cut off frequency and saturating at 35 db at frequencies in the range of 100 MHz) with e.g. a quiescent current of only 30 μA and an output capacitance (or tank capacitance) of 100 pF. In some embodiments, the capacitance can be fully integrated on-chip. Measurement results show that the circuit techniques of the present invention significantly improve the power integrity and ground bounce on the power supply lines. In some of the embodiments, the EMI-Suppressing Regulator can be arranged to work in mixed-mode circuits, e.g. for automotive electronics applications.

Embodiment of FIG. 1

A first embodiment of the invention is illustrated in schematic form in FIG. 1. The inventors recognised that for low noise digital cells, using a current source can provide a major di/dt reduction, and that slower variations of current provides better EMC performance. Furthermore minimizing the static power consumption is useful for practical applications. To achieve a smarter way of controlling how current is delivered to the internal digital cores, a circuit according to a first embodiment is shown in FIG. 1. This shows a battery to represent a power source schematically with an associated resistance and inductance R,L. In general the power source could be any DC power supply source e.g. a dynamo, a fuel cell, a photovoltaic cell, etc. This power source can be remote from the regulator circuit, in which case, the power supply lines to the regulator can be long enough to act as an antenna and can radiate EMI depending on an amount of current and a rate of change of the current. FIG. 1 also shows an EMI suppressing regulator having components shown within the dotted lines. The above mentioned regulator can encompass the EMI suppressing regulator shown and other optional components as desired, such as the series regulator. Other components can be added without departing from the present invention e.g. as defined in the attached claims.

The regulator has a controllable current source (shown coupled to Vbat), a control circuit (labelled "(Control Circuits"), and a tank capacitor (Ctank). A power control circuit or series voltage regulator labelled "Series Regulator" which converts the voltage Vout to a lower voltage such as 3.3-V, or other value, e.g. for integrated circuitry such as internal digital cores is also shown. The higher the voltage Vout, the more energy will be stored in the tank capacitor (Ctank) to supply peak current to the digital core. When the regulator is connected to a varying load, the varying load causes current drain with lower frequency and higher frequency components from the power supply. In this embodiment, the Ctank is connected to the series regulator, to act as an energy reservoir to be able to provide brief peaks to the regulated power supply output. This means the capacitor effectively supplies higher frequency components of the regulated power supply output i.e. the capacitor Ctank will be able to source current for periods of time determined by (a) the actual capacitance of Ctank, (b) the amplitude of current required by the digital core connected to the series regulator, (c) the minimum voltage Vout compatible with proper operation of the series connected regulator. In a first approximation, Ctank will be able to provide an average peak current <I peak> for a period of time $\Delta t \approx Ctank*(Vout-Vout\ min)/<Ipeak>$ where Vout is the voltage Vout when the digital core is dormant and Vout min the minimum voltage Vout for which the series regulator will still be able to generate the required supply voltage VDD Core to the digital core. The higher frequency components of the regulated voltage correspond to transients with frequencies around $1/\Delta t$ or above. The EMI-Suppressing Regulator which is shown inside the dashed box on FIG. 1 forms a stage preceding the series regulator in this example, though other arrangements can be envisaged. The EMI-Suppressing Regulator determines the way to deliver the current to series regulator and hence the internal digital core. The control circuit samples Vout and compares it with a reference voltage and outputs a control signal. The current source is controlled by the control signal. The current source is used to charge the Ctank according to the value of the control signal. When the large peak current (I_internal, and shown by way of example in the digital core box) is dissipated in the internal digital core, in order to keep the lowered VDDcore constant, the same amount of peak current flows through Series Regulator (again shown graphically outside the series regulator box). However, the external current (IV-bat/IGNDcore) is limited by the current source, and the peak charge is substantially supplied from the Ctank. This slower rate of change of the current supplied by the power source, e.g. battery, is also shown graphically in FIG. 1. When the internal current (Iinternal) becomes small, the Ctank is charged again via the current source in a controllable and slow way to a nominal 8-V reference level. Therefore, the peak of the external current (IVbat/IGNDcore) is reduced significantly. The EMI suppressing regulator and its tank capacitor Ctank may be integrated in the same semiconductor substrate as the digital core or in a separate semiconductor substrate.

Figure 2:
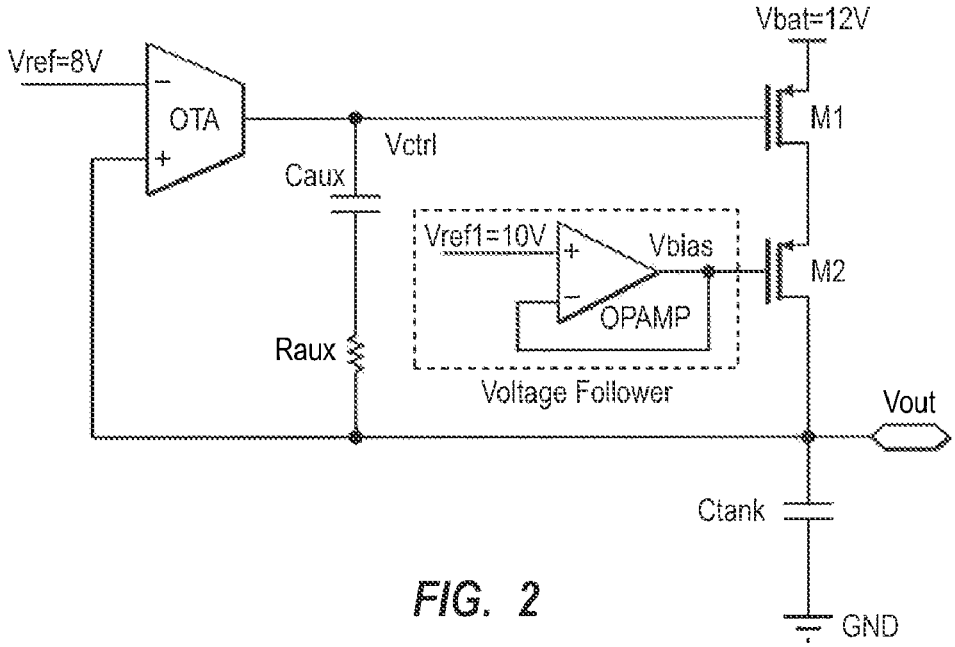
FIG. 2 is a schematic of another embodiment of the EMI-Suppressing Regulator.

Embodiment of FIG. 2

FIG. 2 shows another embodiment, showing an implementation of the EMI-Suppressing Regulator in more detail. In this embodiment, the controller is provided by an amplifier such as an operational amplifier and especially an operational transconductance amplifier OTA, with Pass elements Caux and Raux in series between the output and the positive input of the OTA. These components and the Ctank form a feedback loop which acts as a low pass filter. It is a continuous mode circuit that ensures the low di/dt noise, and hence low EMI, e.g. compared with some common switching mode power supply techniques. The output impedance of the OTA (Operational Transcon-ductance Amplifier) and the compensation capacitance Caux determine the switching speed and hence determine the di/dt noise. The Ctank acts as energy reservoir when low switching or no switching occurs. The controllable current source is shown by transistors M1 and M2 having their current paths coupled in series to form a cascode structure. This can provide further di/dt noise reduction since the coupling from Vout to the power supply Vbat is greatly decreased. The OTA output is coupled to the gate of M1, while M2 is coupled to a voltage follower structure. This has an operational amplifier labelled OPAMP with negative feedback and can ensure that the signal at the gate of M2, Vbias, is biased as a low impedance node. This can reduce the coupling from Vbias to the source of M1 and further to Vbat node. The Caux and Raux components can act as a frequency compensation path to help ensure the stability of the circuit. On the other hand, the Raux can resist the current variation from Vout to Vctrl and further to Vbat node.

Measurement Results

Figure 3:
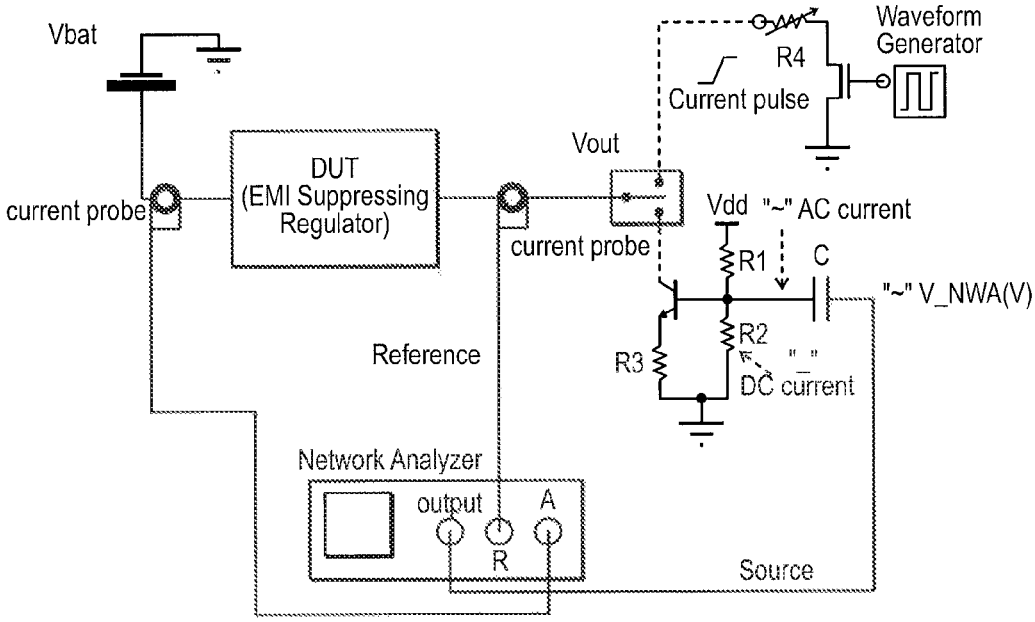
FIG. 3 shows an example of a di/dt transient and transfer function measurement setup.

A di/dt transient and transfer function measurement setup is shown in FIG. 3. The load current transient was generated by the NMOS transistor. In order to measure the current transfer function, AC current was coupled with a capacitor which is triggered by a Vector Network Analyzer. The Network analyzer is used to monitor current into the device under test DUT, such as the EMI suppressing regulator. All the current information is picked up by CT-6 current probes from Tektronix.

Figure 4A:
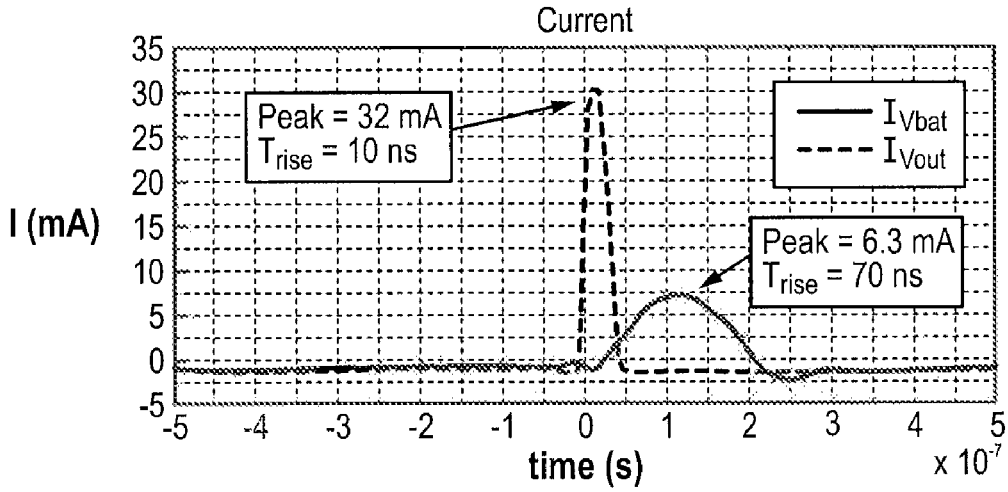
FIGS. 4*a* and 4*b* show graphs having a transient di/dt noise comparison.
Figure 4B:
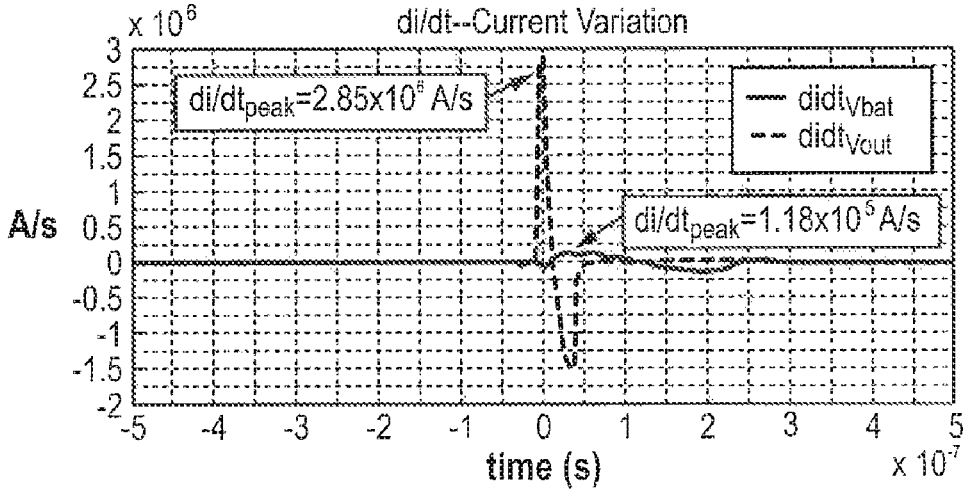

The transient di/dt noise measurement involved generating a load current transient stimulus by a NMOS transient applied at Vout node. The current probes convert current flowing through Vbat and Vout to a measurable voltage. With matching 50 ohms impedances, the sensitivity of the probe is 5 mV/mA. The measured current comparison and di/dt comparison are shown on FIG. 4*a* and FIG. 4*b*, respectively. In FIG. 4*a*, the peak current value is reduced more than 5 times (e.g. more than 5 to 10 times), and the rise time is increased about 7 times. In FIG. 4*b*, di/dt reduction is more than 24 times (e.g. 20 to 30 times). The di/dt TF (transfer function) measurement is made as follows. When the digital core is switching, the large current peak with short duration and sharp rising and falling times injects noise that spans a wide frequency spectrum. The current transfer function is defined as:

$$\frac{\left(\frac{di}{dt}\right)_{vbat}}{\left(\frac{di}{dt}\right)_{vbat}} = \frac{sI(s)_{vbat}}{sI(s)_{vout}} = \frac{I_{vbat}(s)}{I_{vout}(s)}. \tag{1}$$

Figure 5A:
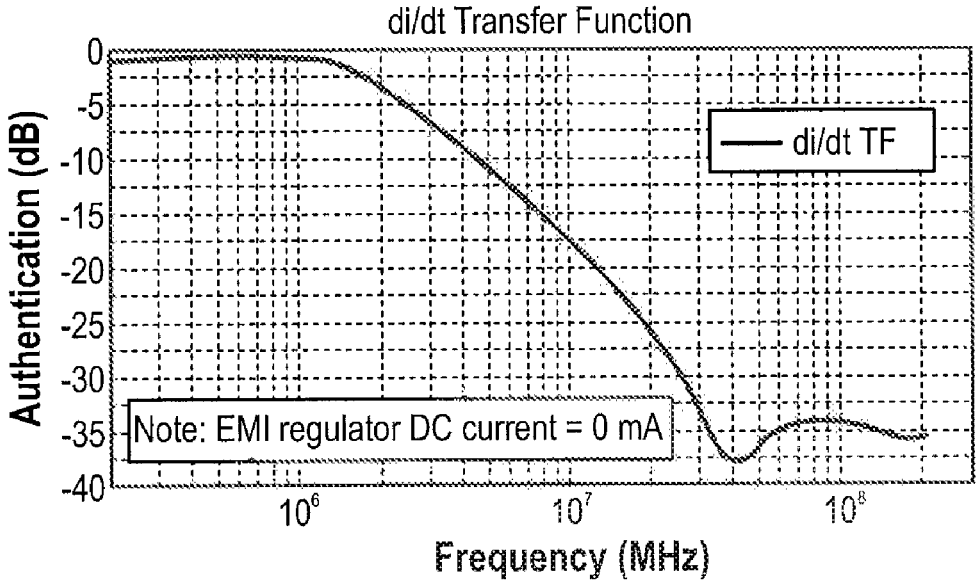
FIGS. 5*a* and 5*b* show graphs of di/dt transfer function and the injected AC current amplitude.
Figure 5B:
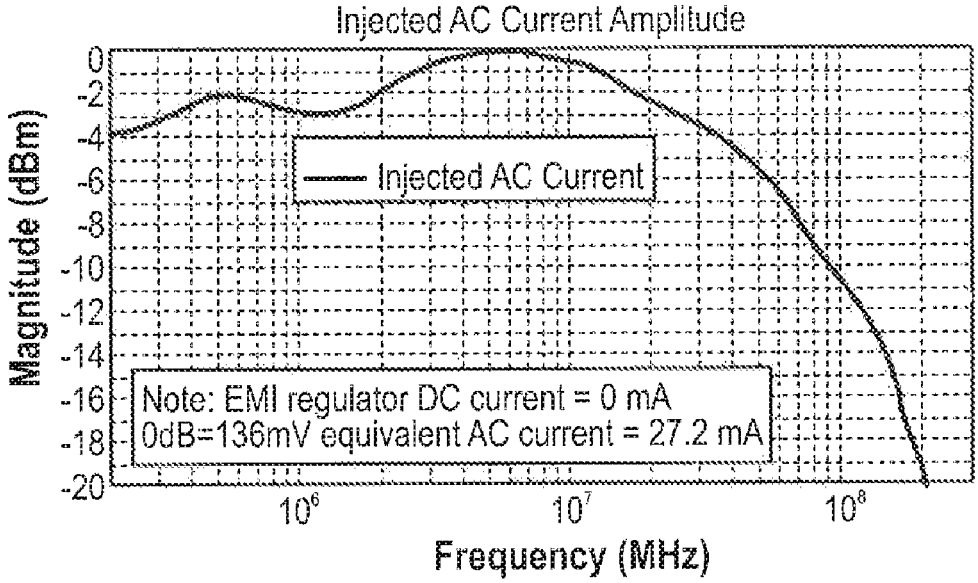

The current transfer function serves as the figure-of-merit (FOM). It shows how the EMI-Suppressing Regulator can reject the high frequency di/dt noise. The load current in the EMI-Suppressing Regulator is about 0 mA. Starting from this load current, AC currents are injected at different frequency by a Network Analyzer via R3. Then as shown in FIG. 3, the ratio of A/R is the di/dt transfer function, where R is the Ivout(s) as the reference level, and A is Ivbat(s). FIG. 5*a* shows the measured di/dt transfer function. The −3 dB cut-off frequency is around 1.6 MHz and the attenuation is saturated at 30 MHz. The maximum di/dt noise attenuation is 35 dB. The injected AC current amplitude is shown on FIG. 5*b*. The 0 dB in magnitude is equivalent to AC current amplitude 27.2 mA.

Above has been described a regulator circuit which receives a power supply (Vbat) and provides a regulated power supply output (Vout, VDD_core) suitable for a wide range of applications in driving semiconductor devices, electronic devices especially integrated circuitry (Digital Core). When the regulator is connected to a varying load, the varying load causes current drain with lower frequency and higher frequency components from the power supply. The regulator circuit has a controllable current source circuit (M1, M2), a controller (OTA, Caux, Raux) and a capacitor (Ctank), such that an output of the controllable current source circuit can provide a lower frequency current part of the regulated power supply output, and the capacitor can supply a higher frequency current part of the regulated power supply output. The controllable current source circuit is controlled according to feedback from the regulated power supply output, and to restrict a rate of change of the output of the controllable current source circuit. The amount of EMI noise caused by high rate of change of current in power supply lines to the regulator circuit can be reduced. This can be done more efficiently or using a smaller capacitor than known arrangements.

A low EMI noise power supply technique has been described. Embodiments can have the advantages of having comparable reduction on di/dt noise with low noise digital cells only, being more power efficient than the low noise digital cells and can have similar power consumption to the conventional CMOS logic. Finally, it is a global approach and can be adjusted to a wide range of chip size and power consumption level.

Other examples and advantages can be envisaged.

The invention claimed is:

1. A regulator circuit arranged to receive a power supply and to provide a regulated DC power supply output to a varying load, the varying load causing current drain with lower frequency and higher frequency components from the power supply, the regulator circuit having a controllable current source circuit, a controller arranged to control the controllable current source circuit, and a capacitor, the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source circuit.

2. The circuit of claim 1, the capacitor comprising an integrated capacitance component.

3. The circuit of claim 1 being integrated with the integrated circuitry coupled to the regulated power supply output.

4. The circuit of claim 1, being arranged to provide attenuation in rate of change of current of the received power supply for a given rate of change of current of the regulated power supply output by more than −20 dB at frequencies above $10^8$ Hz.

5. The circuit of claim 1, the controllable current source circuit being arranged to charge the capacitor.

6. The circuit of claim 1, the controller comprising a low pass filter circuit in a feedback path from the regulated power supply output.

7. The circuit of claim 6, the filter comprising an operational amplifier.

8. The circuit of claim 1, the controllable current source comprising a cascode structure.

9. The circuit of claim 8, the cascode structure comprising a pair of series coupled transistors, a first of the series coupled transistors being controlled by the controller, and a second of the series coupled transistors being controlled by a voltage follower circuit.

10. The circuit of claim 1, having a series voltage regulator arranged to convert the voltage of the regulated power supply output.

11. An integrated circuit having power control and logic circuitry and a regulator circuit arranged to receive a power supply and to provide a regulated DC power supply output to provide the regulated power supply to the logic circuitry the regulator circuit having a controllable current source circuit, a controller arranged to control the controllable current source circuit, and a capacitor, the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source.

12. The circuit of claim 11, the capacitor comprising an integrated capacitance component.

13. The circuit of claim 11 being integrated with the integrated circuitry coupled to the regulated power supply output.

14. The circuit of claim 11, being arranged to provide attenuation in rate of change of current of the received power supply for a given rate of change of current of the regulated power supply output by more than −20 dB at frequencies above $10^8$ Hz.

15. The circuit of claim 11, the controllable current source circuit being arranged to charge the capacitor.

16. The circuit of claim 11, the controller comprising a low pass filter circuit in a feedback path from the regulated power supply output.

17. The circuit of claim 16, the filter comprising an operational amplifier.

18. The circuit of claim 11, the controllable current source comprising a cascode structure.

19. The circuit of claim 18, the cascode structure comprising a pair of series coupled transistors, a first of the series coupled transistors being controlled by the controller, and a second of the series coupled transistors being controlled by a voltage follower circuit.

20. The circuit of claim 11, having a series voltage regulator arranged to convert the voltage of the regulated power supply output.

21. A method of manufacturing the integrated circuit having power control and logic circuitry, and a regulator circuit, the regulator circuit being arranged to receive a power supply and to provide a regulated power supply output, the regulator circuit having a controllable current source circuit, a controller arranged to control the controllable current source circuit, and a capacitor, the controllable current source circuit and the capacitor being coupled together such that an output of the controllable current source circuit can provide a lower frequency current part of the regulated power supply output, and such that the capacitor can supply a higher frequency current part of the regulated power supply output, and the controller being arranged to control the controllable current source circuit according to feedback from the regulated power supply output, and to restrict a rate of change of the output of the controllable current source circuit, the method having the steps of forming the controllable current source circuit, forming the controller arranged to control the controllable current source circuit, and forming the capacitor.

22. A method of regulating a power supply, to provide a regulated power supply output, a regulator circuit being provided having a controllable current source circuit, and a capacitor, the method having the steps of receiving the power supply and controlling the controllable current source circuit according to feedback from the regulated power supply output to provide a lower frequency current part of the regulated power supply output, such that the capacitor can supply a higher frequency current part of the regulated power supply output, and controlling the controllable current source circuit to restrict a rate of change of the output of the controllable current source circuit.

* * * * *